US006550124B2

(12) United States Patent
Krajewski et al.

(10) Patent No.: US 6,550,124 B2
(45) Date of Patent: Apr. 22, 2003

(54) METHOD FOR ADHERING REINFORCING PATCHES DURING SUPERPLASTIC FORMING

(75) Inventors: Paul Edward Krajewski, Sterling Heights, MI (US); Georg M. Barton, Russelsheim (DE)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/899,806

(22) Filed: Jun. 29, 2001

(65) Prior Publication Data

US 2003/0000624 A1 Jan. 2, 2003

(51) Int. Cl.[7] ..... B23P 17/00

(52) U.S. Cl. ..... 29/423; 29/469.5; 29/525.13; 72/379.2; 156/221

(58) Field of Search ..... 29/421.1, 423, 29/469.5, 416, 525.01, 525.13, 525.14; 72/347, 379.2; 156/155, 344, 247, 221, 306.3

(56) References Cited

U.S. PATENT DOCUMENTS

| | | | | | |
|---|---|---|---|---|---|
| 4,440,337 | A | * | 4/1984 | Eckert | 29/423 |
| 4,818,350 | A | * | 4/1989 | Batzar | 72/347 |
| 5,016,805 | A | * | 5/1991 | Cadwell | 228/118 |
| 5,185,198 | A | * | 2/1993 | Lefeber et al. | 428/251 |
| 5,600,991 | A | * | 2/1997 | Munzen | 72/348 |

* cited by examiner

*Primary Examiner*—David P. Bryant
*Assistant Examiner*—Jermie E. Cozart
(74) *Attorney, Agent, or Firm*—Kathryn A. Marra

(57) ABSTRACT

A method is disclosed for temporarily bonding reinforcing sheet metal pieces or other metal pieces to a sheet metal blank for forming at an elevated temperature such as is employed in superplastic forming of suitable aluminum, magnesium, stainless steel or titanium alloys. The pieces are bonded to the blank in locations in which the piece will acquire a desired shape from co-formation with the blank. Suitable water suspendible sodium silicate compositions, such as water glass bond the piece to the blank during high temperature forming and permit removal after forming.

10 Claims, 1 Drawing Sheet

METHOD FOR ADHERING REINFORCING PATCHES DURING SUPERPLASTIC FORMING

TECHNICAL FIELD

This invention pertains to superplastic forming of two or more layers of sheet metal. More specifically this invention relates to a method for locating and temporarily bonding a sheet metal reinforcement piece to a larger sheet metal blank so that the sheet metal blank and reinforcing sheet can be deformed together in the same elevated temperature stretch forming operation.

BACKGROUND OF THE INVENTION

It is well known that some sheet metal alloys can be subjected to thermo-mechanical processing to yield a microstructure permitting very high elongation under tensile stress at elevated temperature. Suitable aluminum, magnesium, stainless steel and titanium alloys can be processed in this way. Sheet metal blanks of these alloys can then be heated to a suitable forming temperature and stretched over a forming tool or into a die cavity to make complex panels and other parts. These materials are said to be superplastic alloys, or superplastically formable alloys (SPF alloys) and the stretch shaping processes are called superplastic forming (SPF) processes.

SPF alloys such as cold rolled AA5083 sheet stock can be used to form automobile deck lid inner and outer panels, lift-gate inner and outer panels and other body and closure panels. The aluminum alloy sheet metal starting material is hot and cold rolled to a very fine grain size of about ten micrometers. Sheet metal blanks of this material are heated to a temperature of about 450° C. to 500° C. for SPF shaping. They are stretched at relatively high strain rates under the pressure of a suitable working gas such as air, nitrogen or argon against a forming tool or die into a large panel of detailed and complex configuration. In fact, single SPF parts can often replace many separately formed and welded stamped parts of lower elongation material.

AA5083 sheet blanks are often cold rolled to about one to three millimeters in thickness and, as stated, can be SPF stretch formed into strong body or closure panels. However, sometimes it is desirable to increase the thickness of at least some portion of the panel. If the entire panel is to be thicker it is usually possible to form two sheets of like profile at the same time. The sheets are welded or gripped at their edges and deformed together against the forming tool. However, if only small regions of the blank are to be reinforced it is much more difficult to form and apply stiffening or reinforcing pieces to small selected spots. It has proven difficult to suitably shape patches or reinforcing sheet pieces and apply them to the desired shaped spot on an automotive panel.

SUMMARY OF THE INVENTION

This invention provides a method of locating and temporarily bonding a sheet metal reinforcing piece, or other useful metal piece, to a sheet metal blank preparatory to a SPF operation on the two layers. In accordance with a preferred embodiment of the invention, the smaller piece(s) is positioned and bonded on the blank sheet to undergo the same deformation as the adjacent blank sheet region that is intended to be reinforced or otherwise benefited by the second object. A suitable adhesive has been discovered that maintains the reinforcement in place during the stretch forming operation so that the reinforcement sheet takes the same shape as the adjacent region of the metal blank. After forming, the reinforcing piece is removed from the formed sheet until it is desired to permanently fix it to a formed sheet metal part.

The practice of the invention is facilitated by using a suitable high temperature adhesive to bond one or more reinforcing pieces, or other useful parts, to the base sheet metal blank. The adhesive must be easy to apply before forming and easy to remove after forming. The adhesive must be capable of surviving the aggressive heating and forming steps. And the adhesive must be chemically compatible with the sheets so as not to corrode or degrade them. In accordance with the invention, an aqueous solution or dispersion of sodium silicate, i.e., water glass, is preferred. More broadly, an aqueous solution (or dispersion) of an alkali silicate, containing one or more of sodium, potassium or lithium, may be used.

For example, superplastic aluminum sheet alloys, such as AA 5083 of a suitably fine grain microstructure, are used in the superplastic stretch forming of automobile body panels. The designer of such a body panel may wish to provide reinforcing strips of the same alloy composition in selected regions of the panel. An aqueous solution of sodium silicate of suitable concentration and viscosity is very useful in sticking small reinforcing pieces of the alloy to the main sheet metal blank before forming. After the forming operation and suitable cooling of the shaped parts, water can be used to soften the silicate bond and permit removal of the shaped reinforcement piece(s) from the main panel piece. Afterwards, the reinforcement piece can be permanently attached to the panel such as by welding, riveting or other desired means.

Other objects and advantages of the invention will become apparent from a detailed description of a preferred embodiment of the invention.

DESCRIPTION OF THE PREFERRED EMBODIMENT

Figure 1:
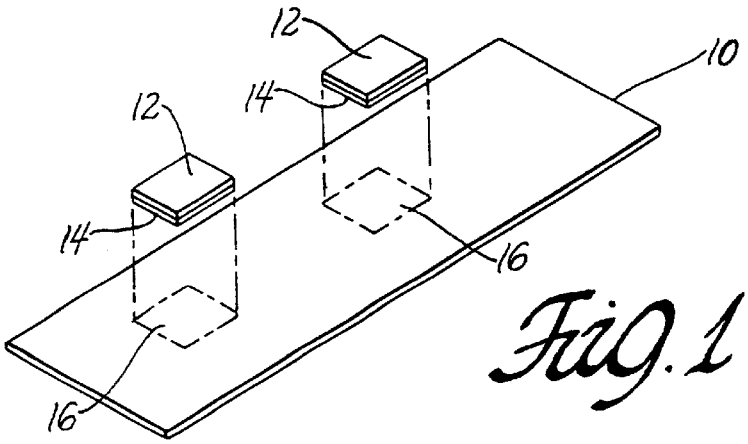
FIG. 1 is a perspective view of a sheet metal blank with two, water glass coated, overlying reinforcing sheets to be positioned on the blank as indicated in outline drawing.

This invention describes a method for temporarily attaching metal patches or other useful metal pieces to a sheet metal blank prior to superplastic forming. The object is to have the secondary piece(s) undergo the same deformation as the adjoining region of the blank material. Generally, the secondary piece will be removed after the forming operation for later permanent attachment to the formed blank or similar piece.

This invention can be used to attach any desired metal piece to the sheet metal blank. However, one important application of this process is to attach reinforcing sheet pieces that will be structural reinforcements for automobile panels and other sheet metal components. The practice of the invention will be described with respect to this important application.

The key to the process involves attaching the reinforcing piece of metal on the SPF blank with water glass, a water soluble glassy substance comprising sodium silicate. Using water glass allows the reinforcement to be accurately located, and to be held in place during forming. The water glass is an excellent adhesive at room temperature. Yet, unlike other candidate adhesives, it is stable and non-reactive at elevated temperatures allowing it to withstand the superplastic forming environment without degradation of the metal pieces and to release the parts after forming.

As described above, superplastic forming allows complex sheet metal shapes to be formed from simple tooling, to reduce forming and assembly costs. An additional benefit to SPF is the ability to make multiple parts from a single die which lowers investment cost for tooling. One method for making multiple parts in a single SPF die is to form two full sheet blanks at the same time. Another practice is to form both the full sheet and a number of reinforcing pieces that would otherwise have to be stamped with a separate die and press. The reinforcements would fit the mating part perfectly as they are formed at the same time, in the same tool thus making assembly operations more robust. However, this reinforcing practice, which might be called "patch forming", has been difficult to use on a production level. One reason "patch forming" has not been implemented in production is that there was no proven method for temporarily attaching the reinforcement to the blank and for keeping the reinforcement attached to the blank during forming.

This invention provides the use of an effective, non-corroding, durable and removable adhesive for use in patch or reinforcement forming. The preferred adhesive is an aqueous solution or suspension of sodium silicate. The material is prepared by dissolving silica in a relatively strong sodium hydroxide solution. If the viscous solution is then dried, a glassy residue is formed. However, it is the viscous sodium silicate solution (often called water glass), or the equivalent, that is used in this invention. The water glass solution readily bonds two metal sheets together at room temperature and maintains the bond during heating of the sheets to a suitable SPF temperature and superplastic forming. At the conclusion of the forming operation and cool down, water may be used to separate the sheets and to remove the water glass.

The practice of the invention will be illustrated by reference to the drawings. FIG. 1 shows an aluminum alloy sheet blank 10. In an actual forming test a SPF AA5083, H19 temper, blank (864 mm×366 mm×1.2 mm) was used. Two small pieces 12 of aluminum sheet (70 mm×70 mm×1.2 mm) of the same aluminum alloy were used as reinforcing pieces. A thin coating 14 of water glass (14 w/o NaOH, 27 w/o $SiO_2$, balance water) was applied to one side of each reinforcing piece 12. The water glass was used as a clear, apparent solution or dispersion of the complex hydrated sodium silicate. The clear liquid had sufficient viscosity to adhere to the pieces during handling. The pieces 12 with waterglass coating 14 were then pressed onto selected areas 16 of the blank 10.

Figure 2:
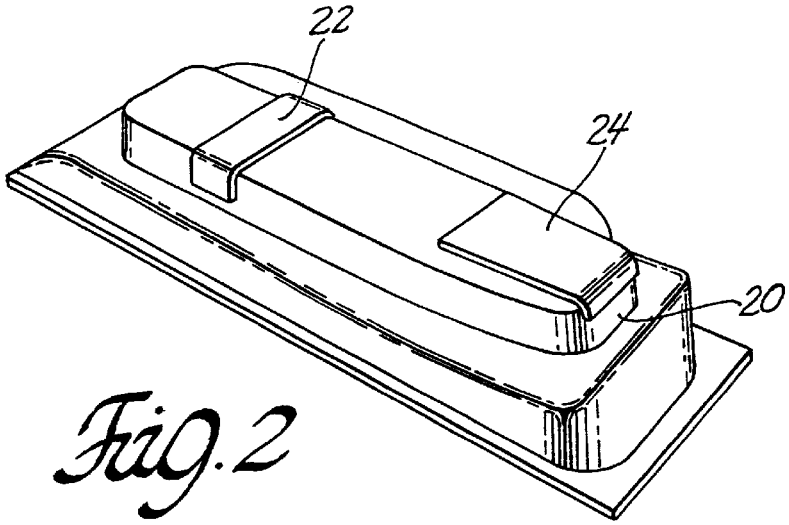
FIG. 2 is a perspective view of a formed sheet metal pan structure with adhering reinforcing pieces.

After drying, the blank 10 with the two reinforcements 12 were heated to 500° C. and formed in a 23 minute cycle, using pressurized air as the working gas, into a die simulating the license plate pocket and surrounding region of an automobile deck lid. This is a severe stretch forming operation for SPF aluminum alloy 5083 as both the blank sheet and reinforcing pieces experience substantial elongation during the forming operation. The panel and reinforcing pieces successfully formed the license pocket shape (see FIG. 2) and the reinforcing pieces 22 and 24 remain bonded to the panel piece 20. Both the formed panel 20 and the two reinforcing pieces 22 and 24 have undergone substantial deformation.

The reinforcing pieces 22 and 24 of aluminum remained attached to the shaped panel 20 after forming and removal of the multi-layer part from the die. In addition, the "reinforcements" remained in the location where they were applied. These results demonstrate that a patch can be attached to a SPF blank prior to forming using a water glass type adhesive.

Figure 3:
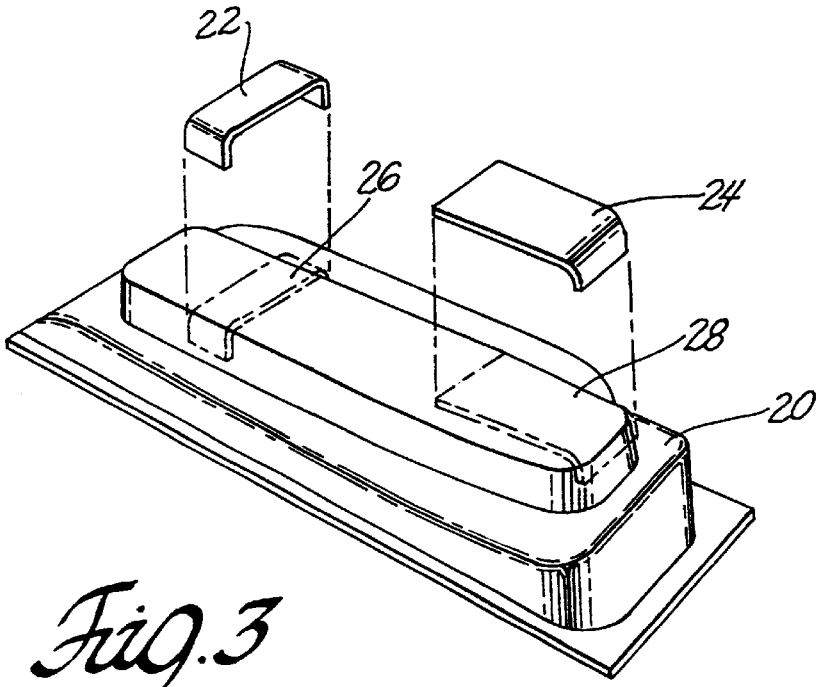
FIG. 3 is a perspective view of the formed pan of FIG. 2 with the reinforcing pieces removed.

The reinforcing pieces 22 and 24 were removed from panel 20 by soaking the assembly in warm water. FIG. 3 illustrates the reinforcing pieces 22 and 24 removed from the panel 20 and show the original locations, 26 and 28 respectively, of the reinforcing pieces. Co-forming of the panel and reinforcing pieces does not mar the surfaces of either part, nor does the use or removal of the silicate adhesive. The reinforcing parts are thus suitably formed for permanent attachment to panel 20 or a like piece. For example, the parts may be welded, riveted or otherwise suitably attached to the main part 20.

Water glass can be prepared in various concentrations and some trial and error may be involved in optimizing a solution for a particular co-forming operation. Sodium silicate is the most prominent member of the family of water dispersible alkali silicates. Such silicates may be represented by the general formula, $M_2O.mSiO_2.nH_2O$, where M is sodium, lithium and/or potassium, m typically varies from 0.5 to 4.0 and n is variable. Sometimes, multivalent metal ions, such as Al+3, Ca+2, or Fe+3, are present as impurities or added. However, ordinary water glass is suitable and preferred.

In addition to "patch forming", water glass could be used to hold two sheets of aluminum together during forming, or to hold nuts or other pieces of hardware in contact with the aluminum blank during forming. The waterglass adhesive could be in combination with a variety of patch locating schemes including templates, die pins, etc.

While this invention has been illustrated in terms of a preferred specific embodiment, it will be appreciated that other forms of the invention could readily be adapted by one skilled in the art. Accordingly, the scope of the invention is to be considered limited only by the following claims.

What is claimed is:

1. A method of temporarily bonding reinforcing sheet metal pieces to a metal blank for simultaneous forming of the reinforcing pieces and blank in an elevated temperature sheet metal forming operation, said method comprising preparing one or more reinforcing sheet metal pieces for location on, and co-formation with, a larger, superplastic formable, sheet metal blank;

determining a location for each said piece on a region of said blank that will acquire a formed shape during said forming operation;

bonding said piece to said blank prior to said forming operation using a water dispersed alkali silicate containing adhesive and, thereafter forming said piece and said blank.

2. A method as recited in claim 1 in which said adhesive is water glass.

3. A method as recited in claim 1 or 2 comprising removing the formed piece from the formed blank and subsequently permanently attaching the formed piece to a formed blank.

4. A method as recited in claims 1 or 2 in which the superplastic sheet metal blank comprises a superplastic alloy composition selected from the group consisting of aluminum, magnesium, stainless steel and titanium alloys.

5. A method as recited in claim 3 in which the superplastic sheet metal blank comprises a superplastic alloy composition selected from the group consisting of aluminum, magnesium, stainless steel and titanium alloys.

6. A method as recited in claim 1 or 2 in which said reinforcing pieces and said blank are of the same composition.

7. A method of heating a superplastic formable sheet metal bland to its superplastic forming temperature and stretching the sheet metal blank against a forming tool so that at least a portion of the sheet takes the shape of the forming tool, said method comprising:

temporarily bonding a second metal object to a predetermined location on the sheet prior to said stretching using an aqueous suspension comprising sodium silicate, and thereafter stretching said sheet such that metal object is carried on the sheet location as the sheet undergoes deformation.

8. A method as recited in claim 7 in which said second metal object is a piece of sheet metal, smaller than said blank, and sheet metal piece undergoes stretching at said location on said blank.

9. A method as recited in either claim 7 or 8 further comprising removing said second metal object from the sheet blank after said stretching step and permanently affixing said second metal object to said sheet, or a similar type stretched work piece at said location.

10. A method as recited in either claim 7 or 8 in which said superplastic sheet metal blank comprises a superplastic alloy composition selected from the group consisting of aluminum, magnesium, stainless steel and titanium alloys.

* * * * *